US011717068B2

(12) United States Patent
Wood et al.

(10) Patent No.: US 11,717,068 B2
(45) Date of Patent: Aug. 8, 2023

(54) ROLL-UP MODULAR PACK WITH INTEGRATED POUCH

(71) Applicant: A Wood Products LLC, Poway, CA (US)

(72) Inventors: Adam Wood, Poway, CA (US); Kevin Klemmt, Seattle, WA (US)

(73) Assignee: A Wood Products LLC, Poway, CA (US)

( * ) Notice: Subject to any disclaimer, the term of this patent is extended or adjusted under 35 U.S.C. 154(b) by 169 days.

(21) Appl. No.: 17/191,482

(22) Filed: Mar. 3, 2021

(65) Prior Publication Data

US 2021/0361045 A1 Nov. 25, 2021

Related U.S. Application Data

(60) Provisional application No. 63/027,058, filed on May 19, 2020.

(51) Int. Cl.

| | |
|---|---|
| ***A45C 11/26*** | (2006.01) |
| ***A45C 13/02*** | (2006.01) |
| ***A45C 13/10*** | (2006.01) |

(52) U.S. Cl.

CPC ..... *A45C 11/26* (2013.01); *A45C 13/02* (2013.01); *A45C 13/1046* (2013.01); *A45C 2013/1015* (2013.01)

(58) Field of Classification Search

CPC ..... A45C 11/26; A45C 13/02; A45C 13/1046; A45C 2013/1015; A45C 5/00; A45C 3/00;

(Continued)

(56) References Cited

U.S. PATENT DOCUMENTS 4,311,022 A * 1/1982 Hall ..... A45C 11/20 62/529
4,513,866 A * 4/1985 Thomas ..... A61F 17/00 190/110

(Continued)

FOREIGN PATENT DOCUMENTS

DE 202007016588 U1 3/2008
WO 2006102585 A2 9/2006

OTHER PUBLICATIONS

International Search Report and Written Opinion dated Jun. 30, 2021 for co-pending International Application No. PCT/US2021/028501; 13 pages.

(Continued)

*Primary Examiner* — Anthony D Stashick
*Assistant Examiner* — Prince Pal
(74) *Attorney, Agent, or Firm* — Lowe Graham Jones PLLC

(57) ABSTRACT

A sheet of material has a left panel secured to the left edge and a right panel secured to a right edge such that a pouch is formed at one end of the sheet of material with a roll panel portion of the sheet extending outwardly form the pouch. Storage structures, such as pouches and tool rolls may secure to the roll panel removably or non-removably. The storage structures and roll panel which may be rolled up and placed within the pouch. A perimeter of the pouch may include a closure mechanism, such as a cord and cord lock for constricting the opening of the pouch. A suspension portion may secure to the roll panel for hanging the roll panel and pouch during use.

16 Claims, 9 Drawing Sheets

(58) Field of Classification Search
CPC ..... A45C 7/00; A45C 5/14; A45C 2007/004; A45C 7/0018; A45C 7/0059; A45C 3/004; A45C 7/0054
USPC ..... 190/107, 109, 110; 206/581, 216; 383/38, 4, 39, 40, 6, 13; 220/359.3
See application file for complete search history.

(56) References Cited

U.S. PATENT DOCUMENTS 4,715,499 A * 12/1987 Franklin ..... A45C 11/26 206/459.5
4,887,751 A * 12/1989 Lehman ..... A45F 3/04 190/110
4,984,906 A * 1/1991 Little ..... A45C 9/00 383/110
5,052,555 A * 10/1991 Harmon ..... A45C 3/00 190/111
5,096,030 A * 3/1992 Espinosa ..... A45C 13/02 190/110
5,566,797 A * 10/1996 Van Himbeeck ..... A45C 3/004 190/102
5,575,362 A * 11/1996 Franklin ..... A45C 5/14 190/102
5,653,337 A * 8/1997 Cirigliano ..... A45F 3/04 224/904
5,779,033 A * 7/1998 Roegner ..... A45C 7/0095 206/6.1
5,800,001 A * 9/1998 Anastasi ..... A45C 3/00 294/146
6,039,474 A * 3/2000 DeChant ..... A45C 3/00 383/66
6,126,054 A * 10/2000 Riemer ..... A45F 3/02 383/41
6,129,210 A * 10/2000 Rustemeyer ..... B25H 3/00 190/1
6,250,470 B1 * 6/2001 Mackenzie ..... A01K 97/08 206/315.11
6,334,519 B1 * 1/2002 Tong ..... A45C 7/0086 190/110
D552,349 S * 10/2007 Greiner ..... D3/278
7,377,279 B1 * 5/2008 Malaspina ..... A61G 1/01 128/870
7,562,408 B1 * 7/2009 Johnson ..... B60P 3/38 5/118
7,604,102 B2 * 10/2009 Albritton ..... A45F 3/04 224/652
7,798,323 B1 * 9/2010 McCann ..... A61F 17/00 206/370
8,851,089 B1 10/2014 Rogers
9,066,840 B2 * 6/2015 Bartholomew ..... A61G 1/01
9,527,630 B2 * 12/2016 Whitmore ..... B65D 33/04
9,936,779 B1 4/2018 Hudson
10,004,307 B2 * 6/2018 Chi Yueh Chen ... A45C 7/0054
10,251,721 B2 * 4/2019 Garratt ..... A61B 50/20
10,349,713 B2 * 7/2019 Millen ..... A45C 7/00
D968,801 S * 11/2022 Wang ..... D3/205
2002/0074199 A1 * 6/2002 Albritton ..... A45C 7/0095 190/110
2003/0080010 A1 * 5/2003 Ho ..... B25H 3/003 206/373
2004/0129602 A1 * 7/2004 Sapyta ..... A45C 5/143 206/748
2004/0222125 A1 * 11/2004 Meing ..... A45C 11/26 206/581
2005/0016808 A1 * 1/2005 Sapyta ..... A45C 13/02 190/110
2006/0207697 A1 * 9/2006 Greiner ..... A45C 7/0095 150/113
2006/0260046 A1 * 11/2006 Landay ..... A47G 9/086 5/413 R
2007/0119883 A1 * 5/2007 Albritton ..... A45C 7/0095 224/584
2007/0138222 A1 * 6/2007 Goldman ..... A45C 11/26 150/112
2008/0035523 A1 * 2/2008 Lemire ..... A45C 13/26 206/774
2008/0289925 A1 * 11/2008 Sapyta ..... A45C 7/0054 190/18 A
2009/0014267 A1 * 1/2009 Day ..... A45C 13/02 190/110
2009/0127045 A1 5/2009 Williams et al.
2010/0155266 A1 * 6/2010 Nicholson ..... A45C 11/26 206/6.1
2012/0031935 A1 * 2/2012 Cook ..... A45C 15/00 224/153
2012/0067682 A1 * 3/2012 Liao ..... A45C 13/02 190/110
2014/0326560 A1 * 11/2014 Bergh ..... A45C 13/02 190/110
2015/0164194 A1 * 6/2015 Kiesling ..... A45C 11/26 132/315
2015/0265020 A1 * 9/2015 McCue ..... A45C 13/103 206/216
2015/0296944 A1 * 10/2015 LaCombe ..... A45C 11/16 206/6.1
2016/0045808 A1 * 2/2016 Nassanian ..... A63B 71/0036 206/216
2016/0367017 A1 * 12/2016 Adams ..... A45F 3/08
2017/0095048 A1 4/2017 Kohn et al.
2018/0042349 A1 2/2018 Baldwin
2018/0368545 A1 * 12/2018 Seegmiller ..... A45C 13/02
2019/0098973 A1 * 4/2019 Proctor ..... A45C 11/26
2019/0298017 A1 * 10/2019 Potts ..... A45C 13/02
2021/0000231 A1 * 1/2021 Salibi ..... A45C 13/123
2021/0321754 A1 * 10/2021 Barber ..... A45F 5/10
2022/0257000 A1 * 8/2022 Bartlett ..... A45F 3/06
2022/0265016 A1 * 8/2022 Hearod ..... A45C 13/1046
2022/0386751 A1 * 12/2022 Sharp ..... A45C 13/02

OTHER PUBLICATIONS

Becca's Creative Notions; Travel Roll Organizers With Detachable Pouches; Feb. 9, 2017; 13 pgs.
Jovilife 4 In 1 Hanging Roll Up Makeup Bag,Travel Toiletry Bag For Women And Men, Hanging Travel Cases—4 Kit Removable Bags Organizer, Make Up, Cosmetics, Bathroom, Medicine, Personal Care; 8 pgs.

* cited by examiner

ROLL-UP MODULAR PACK WITH INTEGRATED POUCH

PRIORITY CLAIM

This application claims the benefit of U.S. Provisional Application Ser. No. 63/027,058 filed May 19, 2020, and entitled TOOL ROLL, which is hereby incorporated herein by reference in its entirety.

FIELD OF THE INVENTION

This application relates to luggage and, more particularly, to luggage that may be rolled up for transport.

BACKGROUND OF THE INVENTION

In some scenarios, a traveler may unpack and remain at a location for some time, in which case luggage need only provide storage capacity for the traveler's items. In other scenarios, the traveler may continue to store items in luggage while at the traveler's destination. A traveler may also access items in a mobile storage container regularly while in transit or at any particular location. In such scenarios, the accessibility and organization of items stored in the luggage also becomes important.

It would be an advancement in the art to provide luggage that provides convenient carry and ready accessibility to stored items.

SUMMARY OF THE INVENTION

In one aspect of the invention, an apparatus includes: a roll panel having a first end and a second end, the roll panel having a length between the first end and the second end greater than a width of the roll panel perpendicular to the length, the roll panel having a front surface and a back surface; a plurality of storage structures secured to a front surface of the roll panel and distributed between the first end and the second end; and a pouch secured to the second end and defining an opening, the pouch sized to receive the roll panel and the plurality of storage structures through the opening when rolled up with the back surface facing outwardly.

The apparatus may include a closure mechanism secured to the opening and configured to retain the roll panel and the plurality of structures within the pouch. The closure mechanism may be a cord extending around the opening and a cord tensioner.

The apparatus may include a first handle secured to the pouch on a first side of the opening and a second handle secured to the pouch on a second side of the opening. The apparatus may include a handle secured to the pouch on a first side of the opening and a closure mechanism spanning between the first side of the opening and a second side of the opening opposite the first side of the opening.

The pouch may have a front panel, back panel, left panel, and right panel defining a volume, the roll panel being secured to the back panel with the front surface facing a same direction as an inner surface of the back panel facing inwardly into the volume. The roll panel and the back panel may be formed of a single monolithic piece of material. The front panel may be formed by the single monolithic piece of material. The left panel may be secured along an edge of the left panel to a portion of a left edge of the single monolithic piece of material and the right panel may secured along an edge of the right panel to a portion of a right edge of the single monolithic piece of material.

The apparatus may include a perimeter portion extending from the left edge of the single monolithic piece of material, along a top edge of the left panel, along a bottom edge of the single monolithic piece of material extending between the left edge and the right edge, along a top edge of the right panel to adjacent the right edge of the single monolithic piece of material, the perimeter portion including a closure mechanism for resisting removal of the roll panel when positioned within the volume. The closure mechanism may be a cord within the perimeter portion and a cord tensioner.

The apparatus may include comprising a first attachment structure secured to one of an inner surface of the back panel and the front surface of the roll panel and a second attachment structure secured to an outer surface of the pouch, the second attachment structure configured to engage the first attachment structure when the pouch is in a rolled up configuration and retain the pouch in the rolled up configuration.

In some embodiments, a suspension portion is secured at a first end of the roll panel. The suspension portion may be a hook. The suspension portion may include a loop secured to the roll panel and a strap secured to the roll panel, the trap having a hook secured thereto and configured to engage the loop.

The plurality of storage structures may include one or more storage structures that are removably secured to the front surface of the roll panel. The one or more storage structures may be removably secured to the front panel by a hook-and-loop material. The plurality of storage structures may include a pocket with an opening on a side of the pocket closest the second end of the roll panel when the roll panel is unrolled.

An apparatus may include: a sheet of material having a top end, a bottom end opposite the top end, a left edge extending between the top end and the bottom end, and a right edge extending between the top end and the bottom end, the right edge being opposite the left edge, the left edge defining a left pouch edge extending from the bottom end partially toward the top end and the right edge defining a right pouch edge extending from the bottom end partially toward the top end, the sheet of material having a pouch portion extending between the left pouch edge and the right pouch edge and a roll panel portion extending between the pouch portion and the top end; a left panel secured to the left pouch edge; a right panel secured to a right pouch edge; and a plurality of storage structures secured to a front surface of the roll panel portion and distributed between the pouch portion and the top end, the roll panel portion defining a back surface opposite the front surface; wherein the left panel, right panel, and the pouch portion define a pouch sized to receive the roll panel portion and the plurality of storage structures when rolled up with the back surface facing outwardly.

The apparatus may include a perimeter portion extending from the left pouch edge, along a top edge of the left panel, along the bottom end of the sheet of material, and along a top edge of the right panel to adjacent the right pouch edge of the sheet of material, the perimeter portion including a closure mechanism for resisting removal of the roll panel when positioned within the volume; a cord positioned within the perimeter portion; and a cord lock engaging the cord and configured to enable tensioning of the word in order to purse the perimeter portion.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
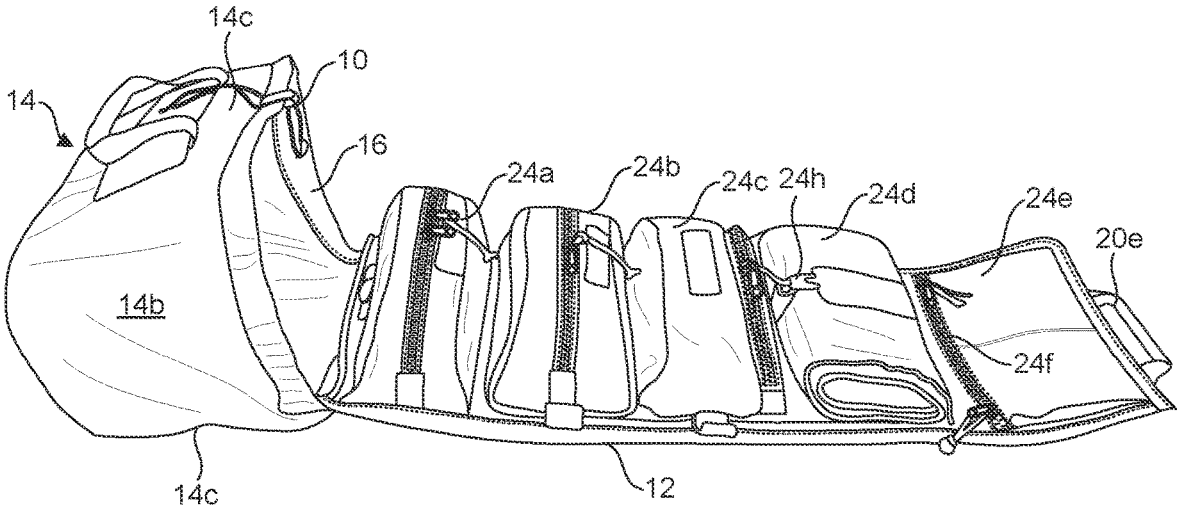
FIG. 1A is an isometric view of a modular tool roll with integrated pouch in accordance with an embodiment of the present invention.
Figure 1B:
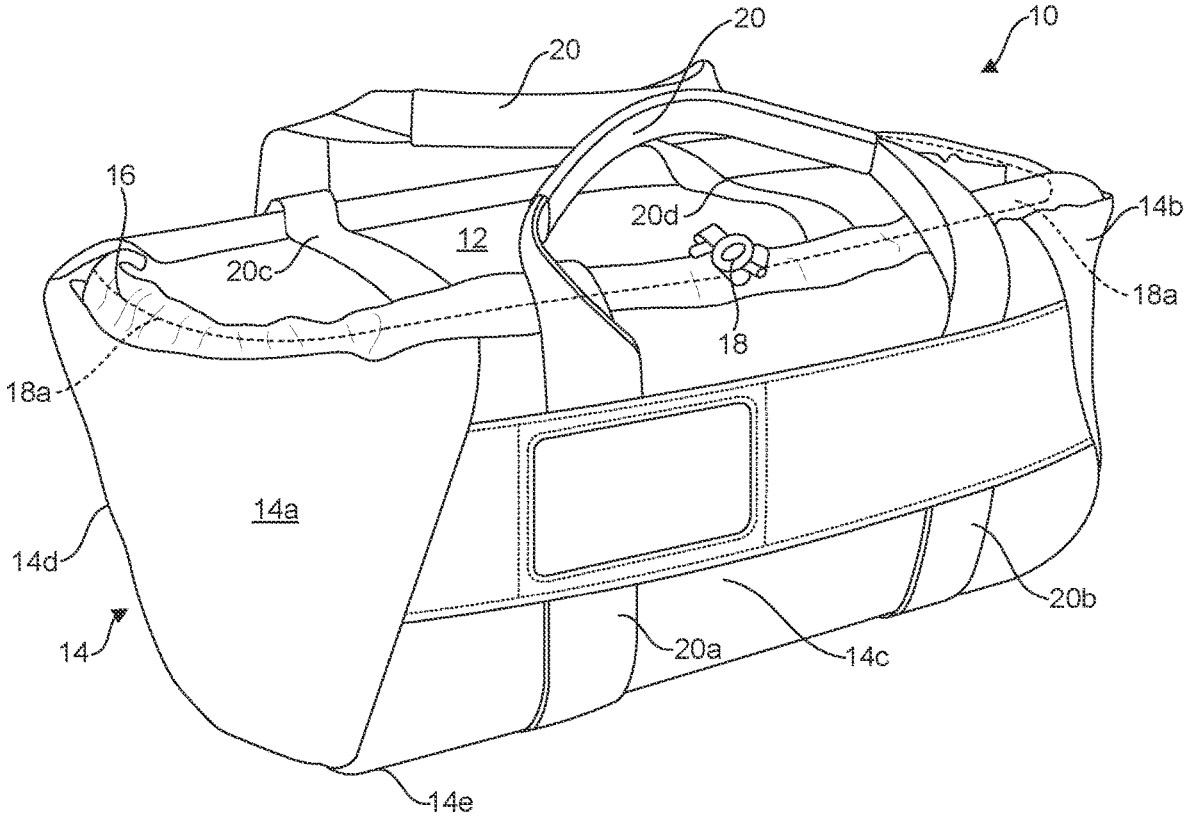
FIG. 1B is an isometric view of the modular tool roll with the tool roll contained within the integrated pouch in accordance with an embodiment of the present invention.

Referring to FIGS. 1A and 1B, a modular tool roll 10 may include a roll panel 12. The roll panel 12 may be a strip of material that, when laid flat on a support surface or suspended, has length between a first and a second end along a first direction that is much longer than (e.g., between 2 and 5 times) the width of the panel 12 in a direction perpendicular to the first direction. The material may be a fabric, such as a synthetic woven fabric. The roll panel 12 may be made of multiple layers of material sewn or otherwise fused to one another. The roll panel 12 may be flexible and capable of being rolled up.

A pouch 14 secures to the second end of the roll panel 12 such that the roll panel secures to a portion of an opening of the pouch 14, e.g., an edge of the pouch 14 defining an opening to the pouch 14. In the illustrated embodiment, the pouch includes left and right side panels 14*a*, 14*b* offset from one another, a front panel 14*c* extending between front edges of the side panels 14*a*, 14*b*, a rear panel 14*d* extending between rear edges of the side panels 14*a*, 14*b*, and a bottom panel 14*e* extending both of between bottom edges of the side panels 14*a*, 14*b* and between bottom edges of the front and rear panels 14*c*, 14*d*. In some embodiments, the roll panel 12 connects to an upper edge of the rear panel 14*d* opposite the bottom edge of the rear panel 14*d*.

In some embodiments, the roll panel 12, rear panel 14*d*, bottom panel 14*e*, and front panel 14*c* are one monolithic sheet of material with the side panels 14*a*, 14*b* sewn to edges thereof to form the illustrated pouch 14. Accordingly, the roll panel 12 may be that portion of the sheet of material that extends outwardly from top edges of the side panels 14*a*, 14*b* to the first end of the roll panel 12.

In the illustrated embodiment, the pouch 14 is flared such that one or both of (a) the front and rear panels 14*c*, 14*d* flare outwardly form one another with distance from the bottom panel 14*e* and (b) the side panels 14*a*, 14*b* flare outwardly from one another with distance from the bottom panel 14*e*.

A perimeter sleeve 16 may be secured around the opening of the pouch 14, such as along upper edges of the side panels 14*a*, 14*b* and front panel 14*c*. In some embodiments, the perimeter sleeve 16 does not extend across the roll panel 12 and rear panel 14*d*. However, in other embodiments, this is the case and the perimeter sleeve 16 is sewn across the material forming the roll panel 12 and rear panel 14*d* such that the perimeter sleeve 16 defines a boundary between the roll panel 12 and the rear panel 14*d*.

The perimeter sleeve 16 may incorporate a tensioner 18. For example, a pair of cords 18*a* may extend through the perimeter sleeve 16 and through the tensioner 18, which may be any sort of cord lock known in the art. The cords 18*a*, 18*b* may be secured within the perimeter sleeve on either side of the tensioning device in embodiments where the perimeter sleeve 16 does not extend across the piece of material forming the roll panel 12 and rear panel 14*d*. Accordingly, the cords 18*a*, 18*b* may be secured within the perimeter sleeve 16 adjacent (e.g., within 0 to 4 cm) the material forming the roll panel 12 and/or rear panel 14*d*. A user may tension the cords 18*a* using the tensioner 18 in order to draw the perimeter sleeve 16 inward. When the roll panel 12 is rolled up and placed within the pouch as shown in FIG. 1B, increasing tension with the tensioner 18 and drawing the perimeter sleeve 16 inward may be effective to hinder removal of the roll panel 12.

In the illustrated embodiment, one or more handles 20 are secured to the pouch 14 for facilitating carrying of the modular tool roll 10. In the illustrated embodiment, a front handle 20 secures to the front panel 14*c* and a rear handle 20 secures to the rear panel 14*d*. As is also apparent, the straps 20*a*, 20*b* forming the handles 20 may extend from the front handle 20, across the front panel 14*c*, under the bottom panel 14*e*, across the rear panel 14*d*, to the rear handle 20. In some embodiments, straps 20*c*, 20*d*, which may be continuous with the straps 20*a*, 20*b*, extend from the back panel 14*d* along a back surface of the roll panel 12 either partially or completely to a first end of the roll panel 12, such as to a top handle 20*e* (see FIG. 2A) secured adjacent (e.g., within 0 to 5 cm of) the first end of the roll panel 12.

One or more pouches 24*a*-24*e* or other storage structures may removably or non-removably secure to a front surface of the roll panel 12. The front surface of the roll panel 12 may be defined as a surface that faces a same direction as an inner surface of the pouch 14, such as at a point of attachment to the rear panel 14*d*. The pouches 24*a*-24*e* may be any kind of container with any kind of closure mechanism known in the art, such as zippers, hook-and-loop (VELCRO), 3M DUAL LOCK, snap fasteners, buckles, or the like.

Figure 2A:
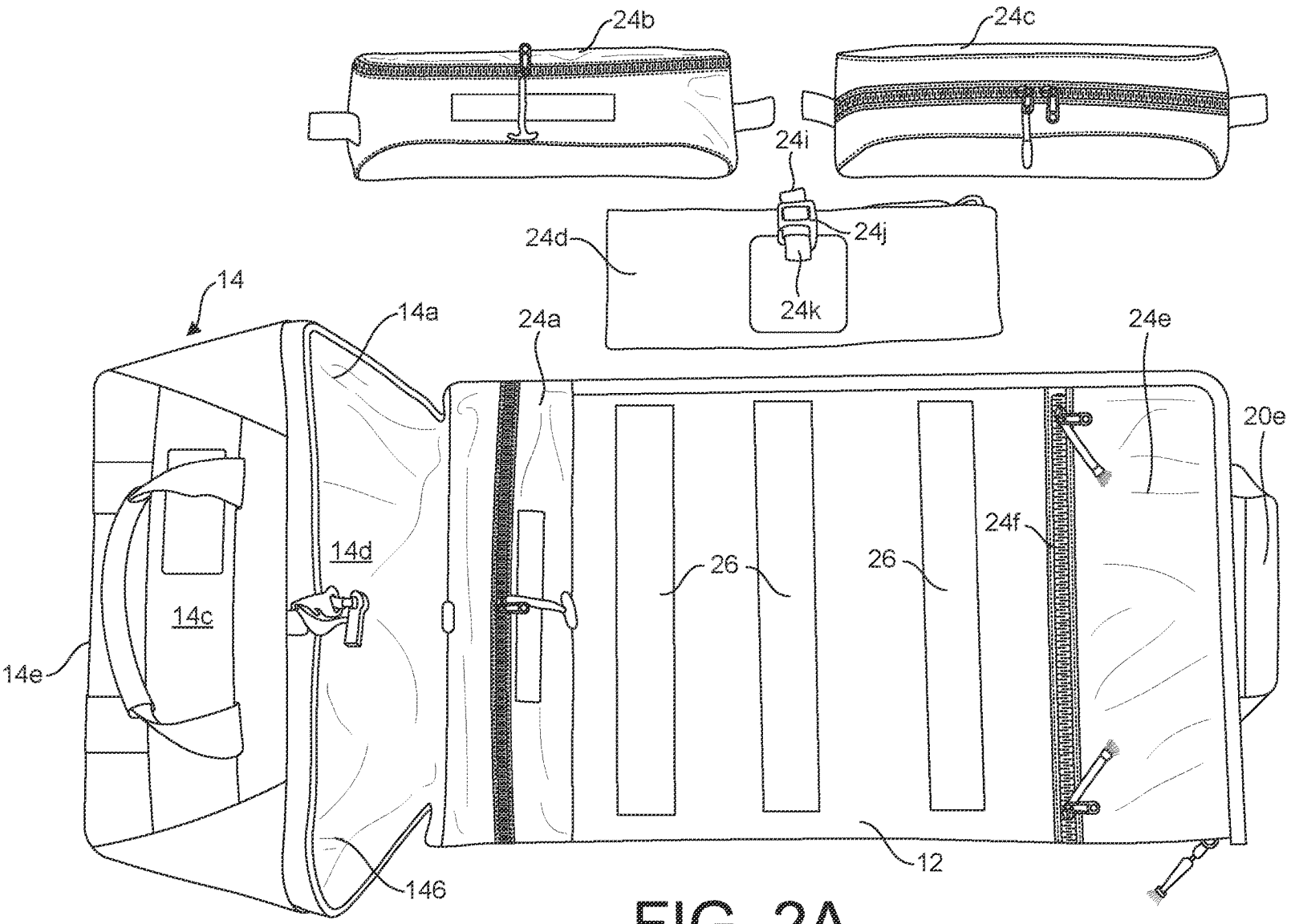
FIG. 2A is an isometric view of the tool roll including fastening material for securing modular pouches in accordance with an embodiment of the present invention.
Figure 2B:
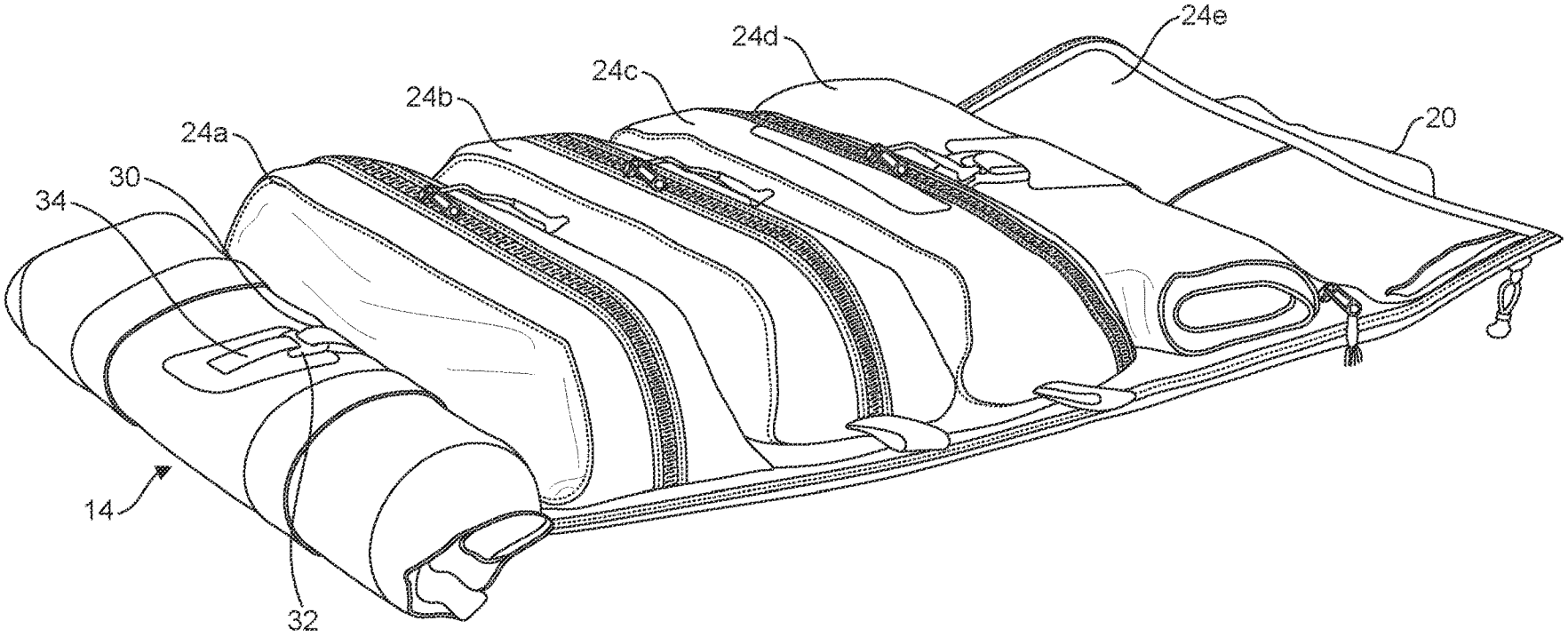
FIG. 2B is an isometric view of the modular tool roll with modular pouches secured thereto in accordance with an embodiment of the present invention.
Figure 2C:
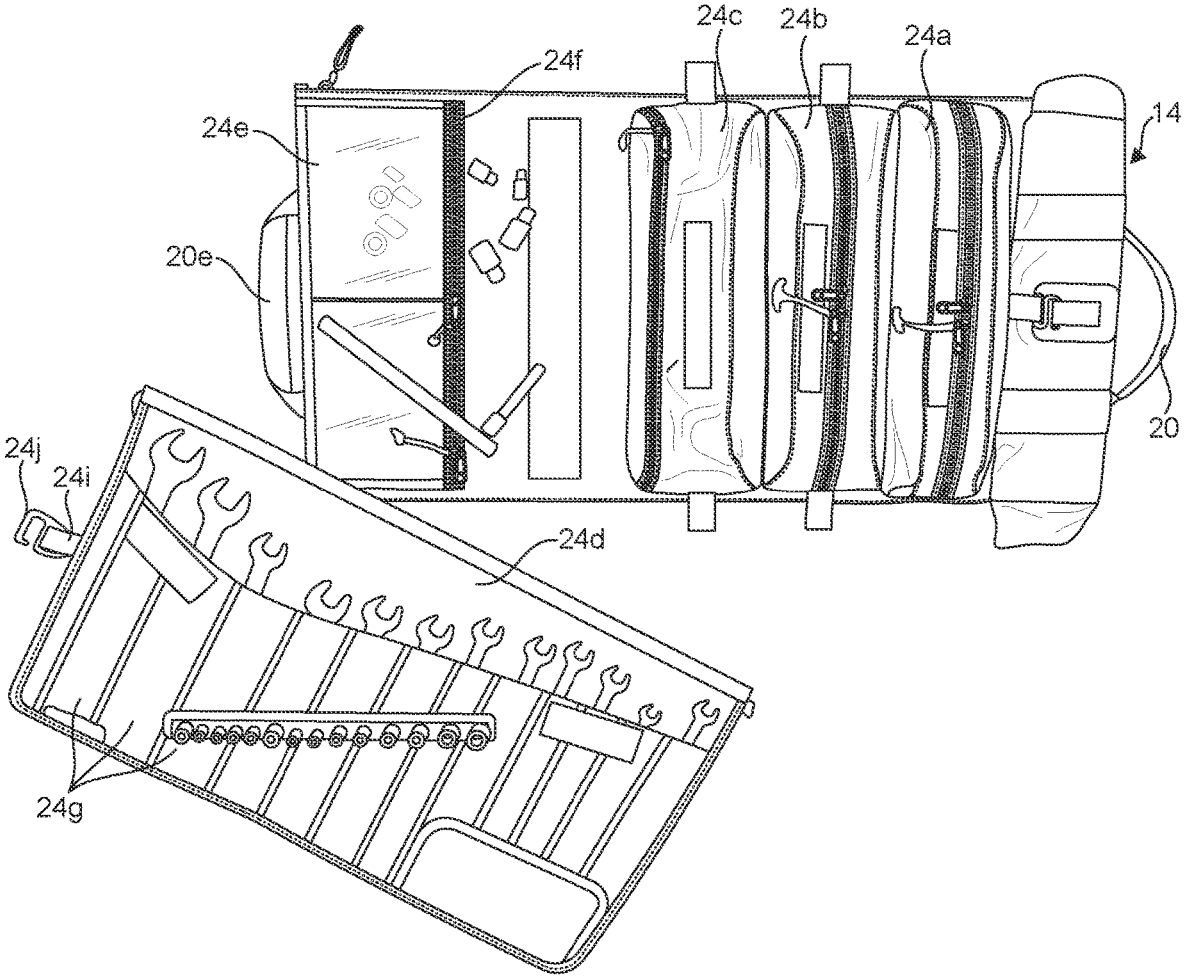
FIG. 2C is a top view of an example use for the modular tool roll in accordance with an embodiment of the present invention.

Referring to FIGS. 2A and 2B, in one configuration, pouches 24*a* and 24*e* are non-removably secured to the front surface of the roll panel 12. One or more fasteners 26 may be secured to the front surface of the roll panel 12. In the illustrated example, the fasteners are areas of hook-and-loop fastening material (e.g., hook material or loop material) and the pouches 24*b*-24*d* include similar areas of fastening material (loop material or hook material) that may be secured to the fasteners 26. In one use case, the tool roll 10 is used in a rolled-out configuration on a flat surface as shown in FIG. 2A. Accordingly, the pouch 24*e* may include an opening 24*f*, e.g., a zippered opening, that is closer to the second end of the pouch than the first end. This may facilitate placing fasteners or other parts on the face of roll panel 12 when it is placed down on a surface. After finishing with the parts or other items the user simply sweeps the items into the pouch 24*e* and secured the zipper or other fastener at opening 24*f*. Of course, this is when the roll is not suspended vertically from handle 20*e*. An example of tools being spread on the roll face adjacent the pouch 24*e* is shown in FIG. 2C. Items may likewise be placed in the pouch 14 while rolled out as shown in FIG. 2A or while rolled up as shown in FIG. 1B.

Further referring to FIG. 2C, one of the detachable or non-removably secured pouches may include a wrench roll 24*d* including a plurality of sleeves 24*g* for receiving end wrenches, socket wrenches, screw drivers, nut drivers, or other tools. The wrench roll 24*d* may include a hook 24*j* secured to the wrench roll 24*d*, such as by a strap 24*i* and another loop 24*k* may also be secured to the wrench roll 24*d*, such as on a side opposite a side to which the sleeves 24*g* are secured. The wrench roll 24*d* may therefore be rolled up with the sleeves 24*g* facing inwardly. The hook 24*j* may be engaged with loop 24*k* (see FIG. 2A) to maintain the wrench roll 24*d* rolled up in the configuration shown in FIG. 2A.

Referring again to FIG. 2B, in some embodiments, structures may be provided to secure the pouch 14 in a compressed or rolled up configuration when not in use. For example, a loop 30 may be secured to the front surface of the roll panel 12. For example, the loop 30 may secure to the roll panel 12 such that all of the pouches 24*a*-24*d* (removable and non-removable) are positioned between the loop 30 and the first end of the roll panel 12. Stated differently, the loop 30 may secure to the roll panel 12 within 3 cm of a line extending between points of attachment of top edges of the side panels 141, 14*b* to the sheet of material forming the roll panel 12. A hook 32 may be secured to the pouch 14, such as by means of the loop 30. One or more loops 34 may secure to any one or more of the rear panel 14*d*, bottom panel 14*e*, and the rear surface of the roll pane 112. The loop 30 and loop 34 may have lengths ensuring that the rolled-up pouch 14 can be enclosed with the hook 32 engaging the loop 34 without requiring an undue exertion by a user, e.g., 1 to 10 pounds of force. The use of a loop 30, hook 32, and loop 34 is just one example of a securement system for securing the rolled-up pouch 14. Other configurations are also possible, such as securing the hook 32 to the loop 34 rather than to the loop 30 and selectively engaging the hook 32 with the loop 30 when the pouch 14 is rolled up.

Figure 3A:
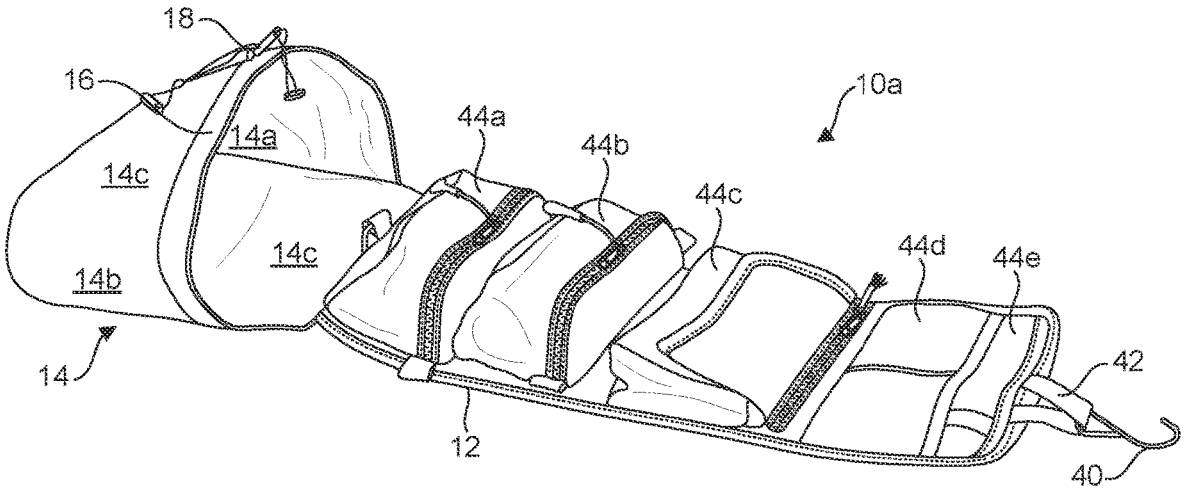
FIG. 3A is an isometric view of a toiletry roll in accordance with an embodiment of the present invention.
Figure 3B:
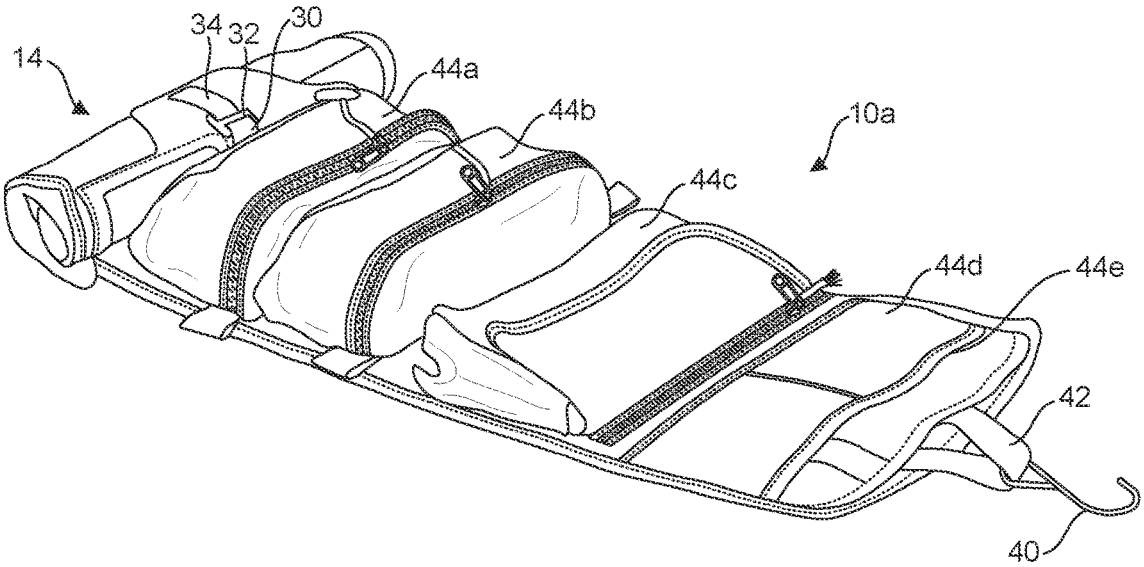
FIG. 3B is an isometric view of the toiletry roll with a pouch in a rolled configuration in accordance with an embodiment of the present invention.
Figure 3C:
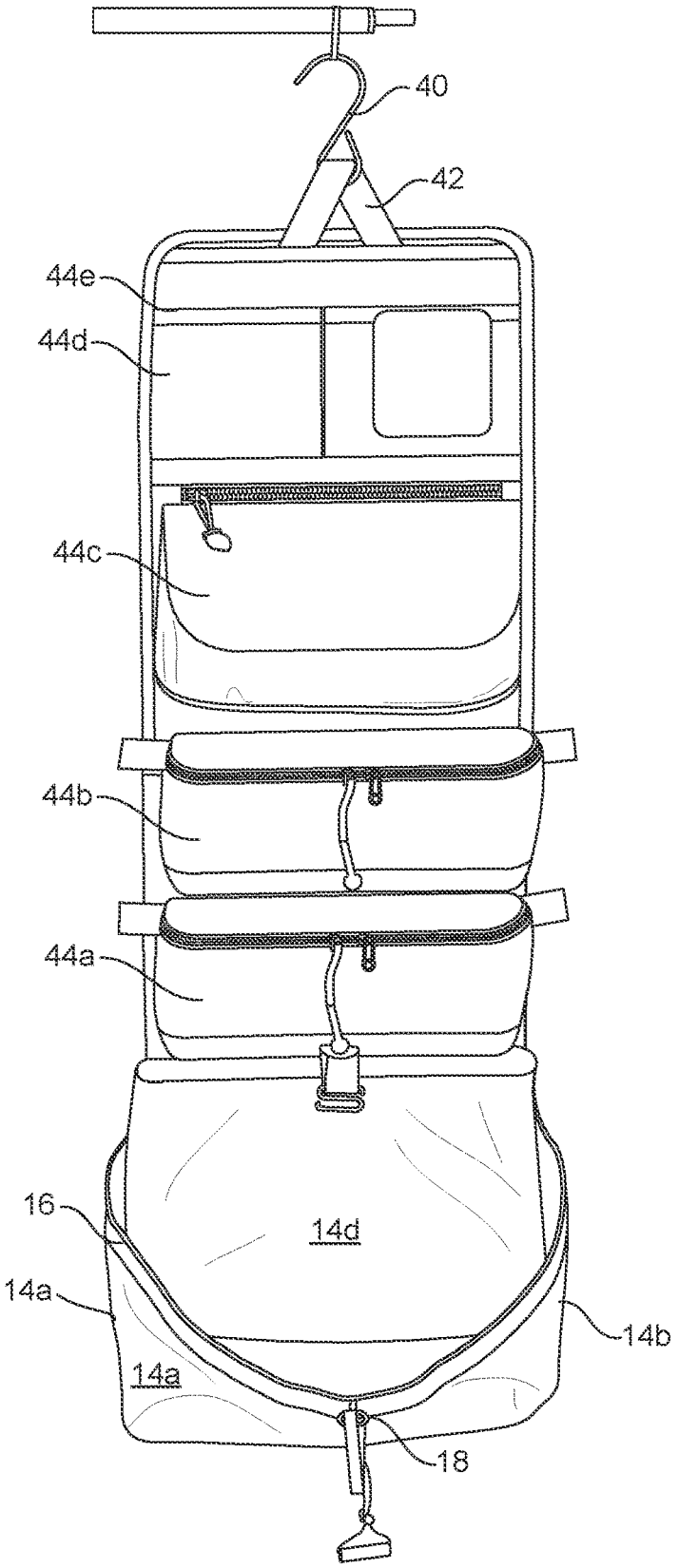
FIG. 3C is a front view of the toiletry roll suspended for use in accordance with an embodiment of the present invention.

FIGS. 3A, 3B, and 3C illustrate another configuration of a roll-up modular pack. One example may be a toiletry roll 10*a* that, unless otherwise indicated, has the same basic configuration as the modular tool roll 10. In the illustrated embodiment, a hook 40, e.g., a hook for a hanger rod, is secured by a strap 42 adjacent to (e.g., 0 to 5 cm from) the first end of the roll panel 12.

The toiletry roll 10*a* may have smaller dimensions than the modular tool roll 10. In the illustrated embodiment, the front surface of the roll panel 12 has one or more toiletry pouches 44*a*-44*d*. Some or all of the pouches 44*a*-44*d* may be removable, such as using hook-and-loop fastener, snaps or other fastening structure. Some or all of the pouches 44*a*-44*d* may be non-removably secured to the front surface of the roll panel 12. As is apparent in FIG. 3B, the pouch 44*d* closest to the first end of the roll panel 12 may have an opening 44*e* that faces toward the first end than to the second end of the roll panel 12 such that items placed in the pouch 44*d* will not fall out when the toiletry roll 10*a* is suspended at the first end.

As for the modular tool roll 10, the toiletry roll 10*a* may include a loop 30, hook 32, and loop 34 for securing the pouch 14 in a rolled-up position as shown in FIG. 3B.

Figure 4A:
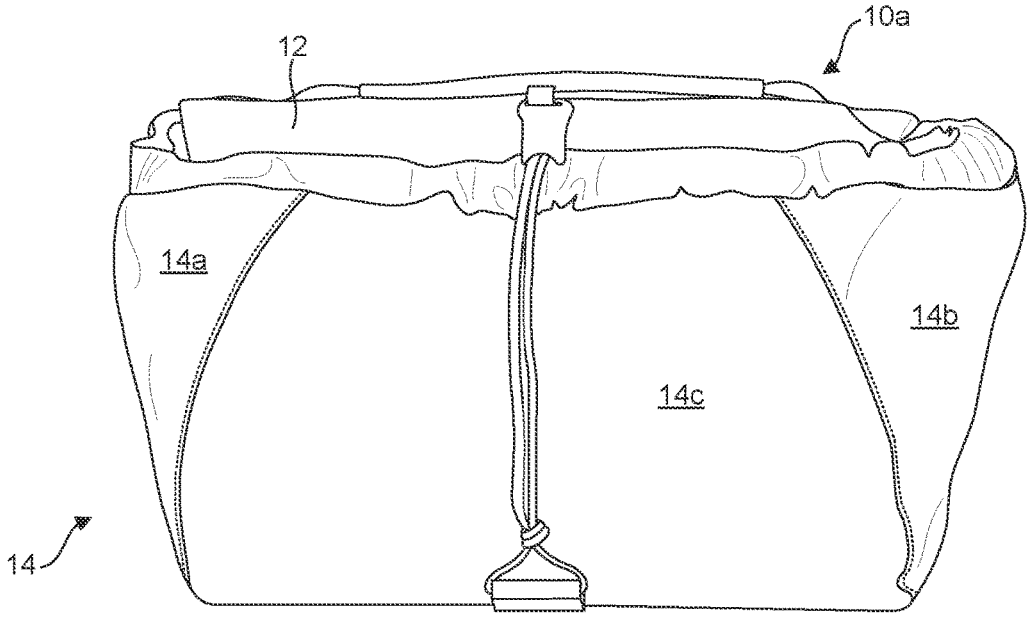
FIGS. 4A to 4C illustrate the toiletry roll with the rolled portion positioned within a pouch in accordance with an embodiment of the present invention.
Figure 4B:
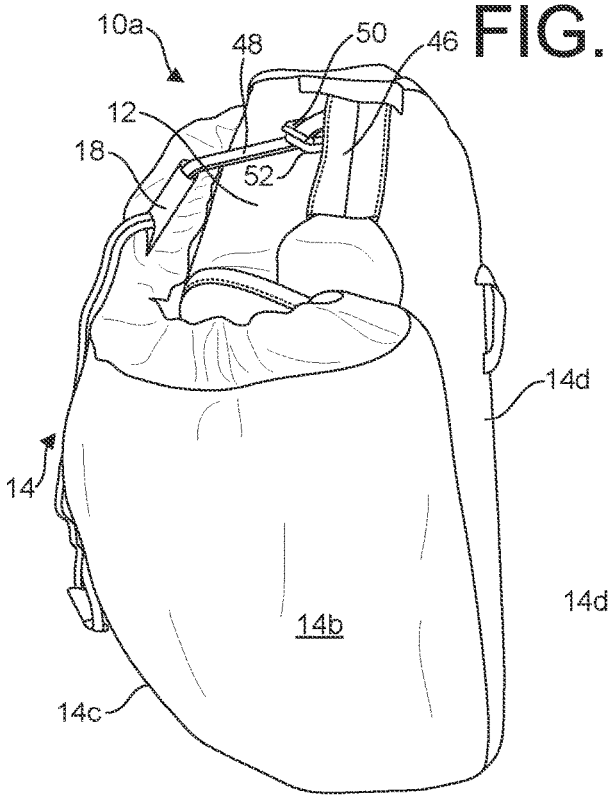
Figure 4C:
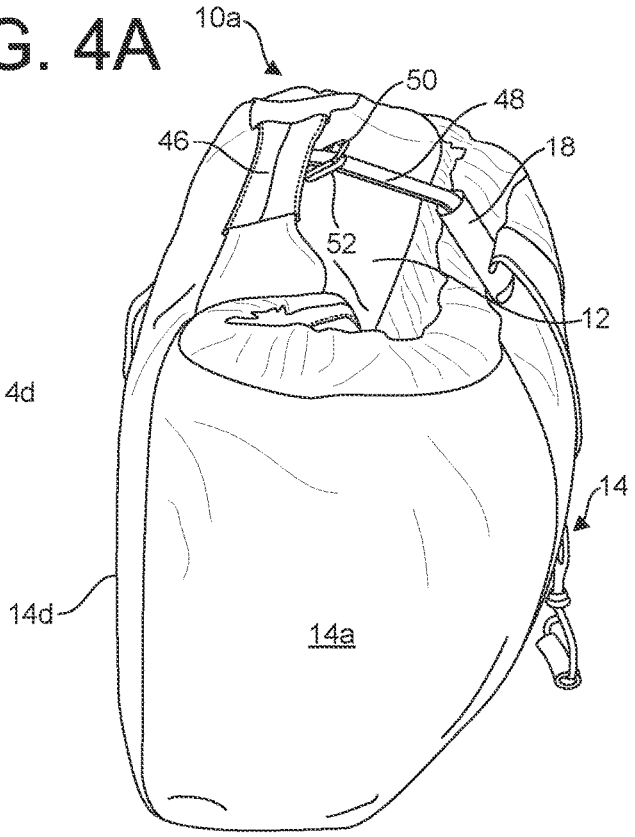

Referring to FIGS. 4A, 4B, and 4C, the roll panel 12 may be rolled up with its front surface facing inwardly and placed in the pouch 14. As for the modular tool roll 10, the opening to the pouch 14 may be closed by applying tension using the tensioner 18.

Inasmuch as the toiletry roll 10*a* may be smaller, a single handle 46 is used in some embodiments, such as secured to the roll panel 12 adjacent the top of the pouch, e.g., vertically at, or within 2 to 10 cm above, the point where the perimeter sleeve 16 abuts the roll panel 12 when the toiletry roll 10 is suspended vertically.

To hinder opening of the pouch, a strap 48 may extend from a point of attachment on the front panel 14*c* or perimeter sleeve 16 to a point on the roll panel 12. For example, the strap 48 may include a buckle or toggle 50 that may be passed through a loop 52 to prevent inadvertent opening of the pouch 14. The loop 52 may be secured to the handle 48 or to a point on the rear surface of the roll panel 12. As is apparent in FIGS. 4A to 4C, the strap 48 may either secure to the tensioner 18 or be secured to a common attachment point on the front panel 14*c* as the tensioner 18.

Figure 5A:
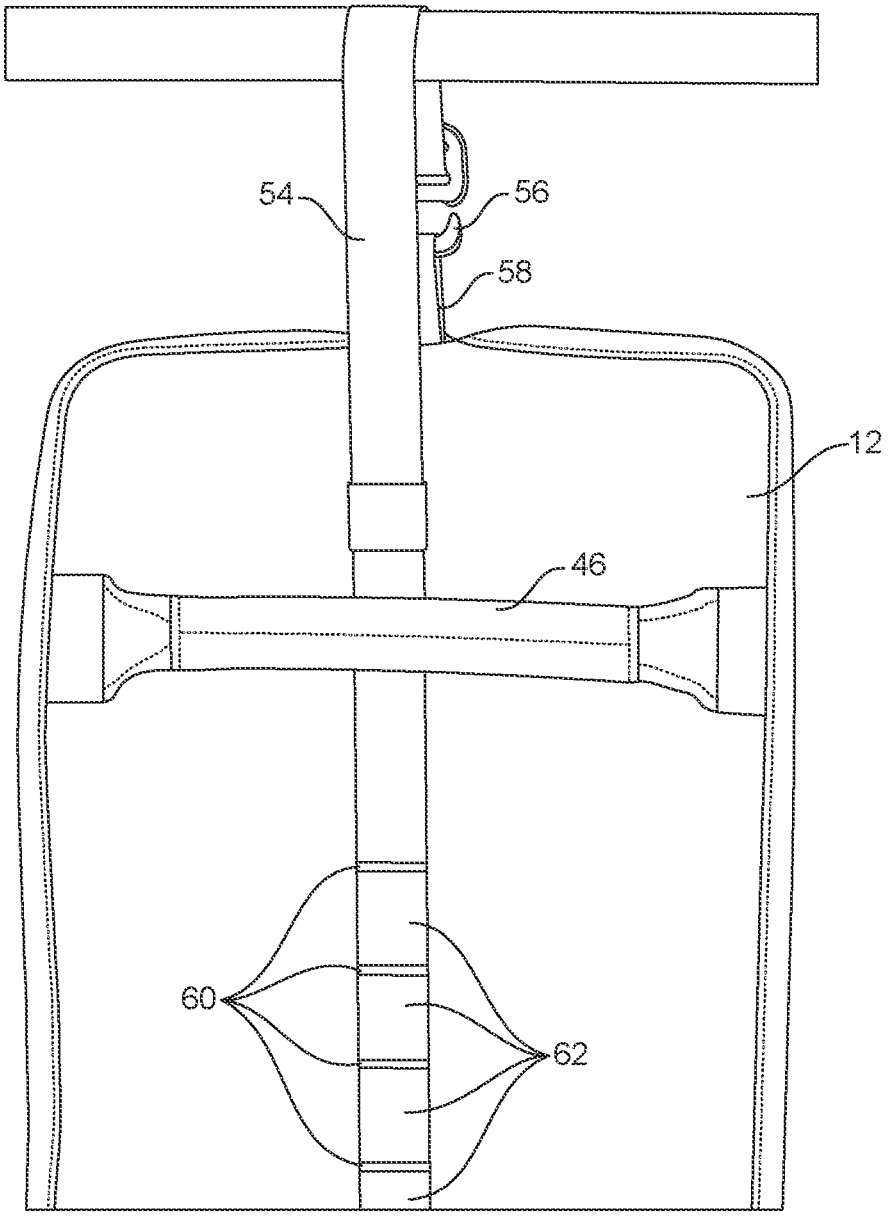
FIG. 5A is a rear view of the toiletry roll with an alternative suspension system in accordance with an embodiment of the present invention.

Referring to FIG. 5A, in some embodiments, suspending of the toiletry roll 10*a* may be performed using a rear strap 54 having a hook 56 secured thereto. A front strap 58 may secure at (e.g., within 0 to 5 cm of) the first end of the roll panel 12 and form a loop. The strap 54 may therefore be passed around a structure, such as a hanger rod, and engage the front strap 58 in order to suspend the toiletry roll 10*a*. A user may place items (clothing, towels, toiletries, etc.) in the pouch 14 while suspended.

As is apparent in FIG. 5A, the rear strap 54 may extend completely or partially from the first end of the roll panel 12 toward a second end of the roll panel 12 and possibly completely around the back panel 14*d*, bottom panel 14*e*, and front panel 14*c*. The rear strap 54 may be locally stitched at points 60 to the roll panel 12, leaving portions 62 of the strap 54 between the points 60 free. Items may be hooked or otherwise suspended on these free portions.

Figure 5B:
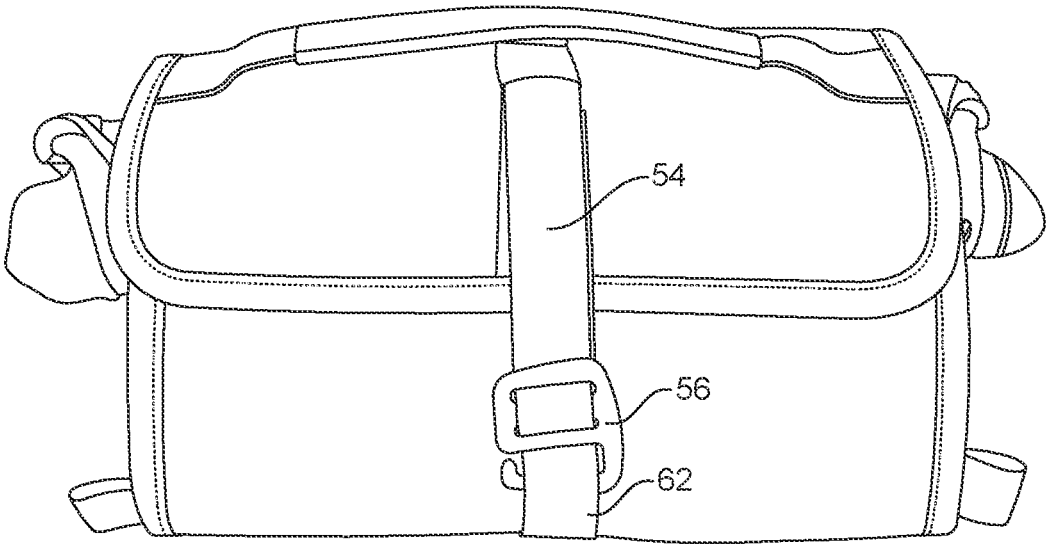
FIGS. 5B and 5C are isometric views of the toiletry roll in a rolled configuration without use of the pouch in accordance with an embodiment of the present invention.
Figure 5C:
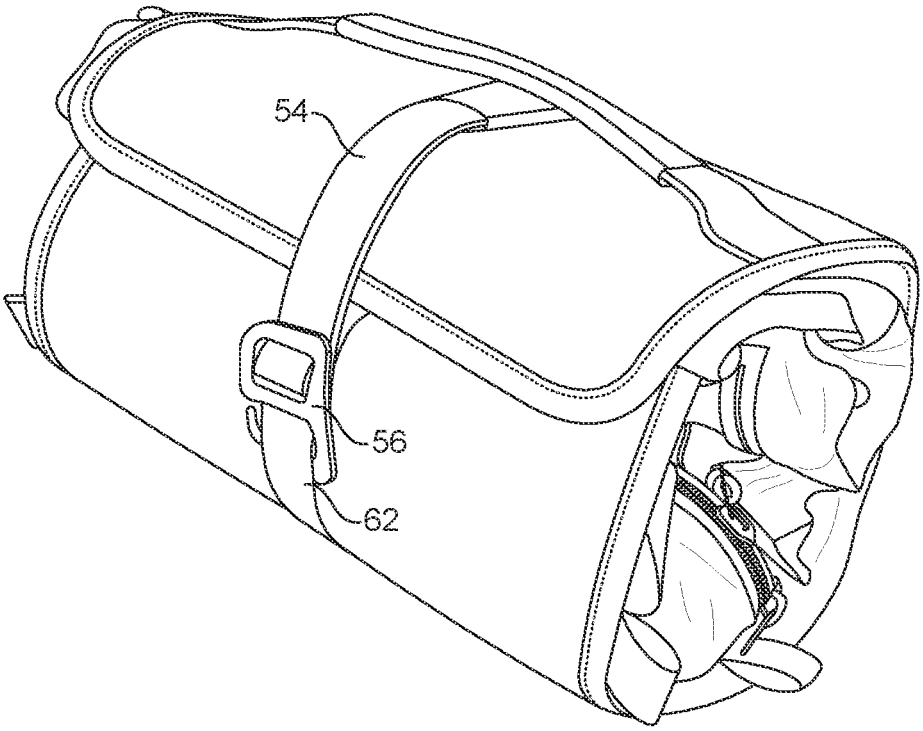

Referring to FIGS. 5B and 5C, the free portions 62 may be used to maintain the toiletry roll 10*a* in a rolled configuration. For example, rather than roll up the roll panel 12 and place it in the pouch 14, the pouch 14 may also be rolled up and the hook 56 engaged with one of the free portions 62 in order to maintain the toiletry roll in the rolled configuration shown in FIGS. 5B and 5C.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:

a roll panel having a first end and a second end, the roll panel having a front surface and a back surface;

a plurality of storage structures secured to a front surface of the roll panel and distributed between the first end and the second end, one or more of the storage structures of the plurality of storage structures being removable and re-securable to the front surface of the roll panel;

a pouch secured to the second end and defining an opening, the pouch sized to receive the roll panel and the plurality of storage structures through the opening when rolled up with the back surface facing outwardly; and an adjustable closure mechanism secured to the opening and configured to retain the roll panel and the plurality of storage structures within the pouch, the pouch being sized to tightly secure the roll panel therein such that when the closure mechanism is secured the roll panel is tightly retained from movement relative to the pouch, the closure mechanism being adjustable to tighten about the roll panel and any contents of the plurality of storage structures secured to the roll panel;

wherein the closure mechanism is a cord extending around the opening and a cord tensioner such that the closure mechanism is configured to constrict the opening with the roll panel inserted within the pouch through the opening.

2. The apparatus of claim 1, further comprising a front handle secured to the pouch on a first side of the opening and a rear handle secured to the pouch on a second side of the opening, the rear handle secured to the pouch rearward of and below the second end of the roll panel.

3. The apparatus of claim 1, further comprising a handle secured to the pouch on a first side of the opening and a closure mechanism spanning between the first side of the opening and a second side of the opening opposite the first side of the opening, the handle secured to the pouch on a back surface of the roll panel at a base thereof, the closure mechanism being adjustable to tighten around contents of the roll panel inside the pouch.

4. The apparatus of claim 1, wherein the pouch has a front panel, back panel, left panel, and right panel defining a volume, the roll panel being secured to the back panel with the front surface facing a same direction as an inner surface of the back panel facing inwardly into the volume.

5. The apparatus of claim 4, wherein the roll panel, the front panel, and the back panel are formed of a single monolithic piece of material.

6. The apparatus of claim 5, wherein a length of the roll panel between the first end and the second end is greater than a width of the roll panel perpendicular to the length.

7. The apparatus of claim 6, wherein the left panel is secured along an edge of the left panel to a portion of a left edge of the single monolithic piece of material and the right panel is secured along an edge of the right panel to a portion of a right edge of the single monolithic piece of material.

8. The apparatus of claim 7, further comprising a perimeter sleeve extending from the left edge of the single monolithic piece of material, along a top edge of the left panel, along a bottom edge of the single monolithic piece of material extending between the left edge and the right edge, along a top edge of the right panel to adjacent the right edge of the single monolithic piece of material, the perimeter sleeve including the closure mechanism.

9. The apparatus of claim 4, further comprising a first attachment structure secured to one of an inner surface of the back panel and the front surface of the roll panel and a second attachment structure secured to an outer surface of the pouch, the second attachment structure configured to engage the first attachment structure when the pouch is in a rolled up configuration and retain the pouch in the rolled up configuration.

10. The apparatus of claim 1, further comprising a suspension portion secured at a first end of the roll panel.

11. The apparatus of claim 10, wherein the suspension portion is a hook.

12. The apparatus of claim 10, wherein the suspension portion includes a loop secured to the roll panel and a strap secured to the roll panel, the trap having a hook secured thereto and configured to engage the loop.

13. The apparatus of claim 1, wherein the one or more storage structures that are removably secured to the front surface of the roll panel are secured thereto with a hook-and-loop material.

14. The apparatus of claim 1, wherein at least one of the one or more storage structures includes a full zipper closure.

15. The apparatus of claim 1, wherein the plurality of storage structures includes a pocket with an opening on a side of the pocket closest the second end of the roll panel when the roll panel is unrolled.

16. An apparatus comprising:

a sheet of material having a top end, a bottom end opposite the top end, a left edge extending between the top end and the bottom end, and a right edge extending between the top end and the bottom end, the right edge being opposite the left edge, the left edge defining a left pouch edge extending from the bottom end partially toward the top end and the right edge defining a right pouch edge extending from the bottom end partially toward the top end, the sheet of material having a pouch portion extending between the left pouch edge and the right pouch edge and a roll panel portion extending between the pouch portion and the top end;

a left panel extending from the left pouch edge;

a right panel extending from a right pouch edge;

a plurality of storage structures removably secured to a front surface of the roll panel portion and distributed between the pouch portion and the top end, the plurality of storage structures having closure mechanism to retain items therein, the roll panel portion defining a back surface opposite the front surface;

wherein the left panel, right panel, and the pouch portion define a pouch having an opening, the pouch sized to closely receive the roll panel portion and the plurality of storage structures when rolled up with the back surface facing outwardly;

a perimeter sleeve extending from the left pouch edge, along a top edge of the left panel, along the bottom end of the sheet of material, and along a top edge of the right panel to adjacent the right pouch edge of the sheet of material, the perimeter sleeve including a closure mechanism for resisting removal of the roll panel portion when positioned within the pouch;

a cord positioned within the perimeter sleeve; and a cord lock engaging the cord and configured to enable tensioning of the cord in order to purse the perimeter sleeve with the roll panel portion positioned in the pouch.

* * * * *